US010657902B2

(12) United States Patent
Lee et al.

(10) Patent No.: US 10,657,902 B2
(45) Date of Patent: May 19, 2020

(54) SENSING CIRCUIT OF DISPLAY DEVICE FOR SENSING PIXEL CURRENT

(71) Applicant: SILICON WORKS CO., LTD., Daejeon-si (KR)

(72) Inventors: Jae Kwan Lee, Seoul (KR); Dong Hyun Hwang, Seoul (KR); Hyun Ho Kim, Suwon-si (KR)

(73) Assignee: Silicon Works Co., Ltd., Daejeon (KR)

( * ) Notice: Subject to any disclaimer, the term of this patent is extended or adjusted under 35 U.S.C. 154(b) by 84 days.

(21) Appl. No.: 15/674,925

(22) Filed: Aug. 11, 2017

(65) Prior Publication Data

US 2018/0061329 A1 Mar. 1, 2018

(30) Foreign Application Priority Data

Aug. 25, 2016 (KR) ..... 10-2016-0108091

(51) Int. Cl.

| | |
|---|---|
| ***G09G 3/3241*** | (2016.01) |
| ***G09G 3/3291*** | (2016.01) |
| ***G09G 3/20*** | (2006.01) |
| ***G09G 3/3258*** | (2016.01) |

(52) U.S. Cl.

CPC ..... *G09G 3/3291* (2013.01); *G09G 3/20* (2013.01); *G09G 3/3241* (2013.01); *G09G 3/3258* (2013.01); *G09G 2320/029* (2013.01)

(58) Field of Classification Search

CPC .. G09G 2320/029; G09G 3/20; G09G 3/3241; G09G 3/3258; G09G 3/3291

See application file for complete search history.

(56) References Cited

U.S. PATENT DOCUMENTS

| | | | | |
|---|---|---|---|---|
| 8,259,044 | B2 * | 9/2012 | Nathan | G09G 3/3233 345/82 |
| 9,171,504 | B2 * | 10/2015 | Azizi | G09G 3/006 |
| 9,343,015 | B2 | 5/2016 | Jo | |
| 2011/0007067 | A1 * | 1/2011 | Ryu | G09G 3/3233 345/214 |

FOREIGN PATENT DOCUMENTS

| | | |
|---|---|---|
| KR | 10-2014-0070105 | 6/2014 |
| KR | 10-2015-0029176 | 3/2015 |
| KR | 10-2015-0031125 | 3/2015 |
| KR | 10-1529005 | 6/2015 |

* cited by examiner

*Primary Examiner* — Ram A Mistry
(74) *Attorney, Agent, or Firm* — Polsinelli PC

(57) ABSTRACT

Disclosed is a sensing circuit of a display device for external compensation of an OLED. The sensing circuit includes a current receiving unit configured to receive a pixel current containing a leakage current, convert the pixel current at a preset current ratio, and output the converted pixel current; a current source unit; a current sinking unit; a current detection unit; and a detection signal output unit configured to sample an offset voltage corresponding to the leakage current using the detected current.

9 Claims, 5 Drawing Sheets

SENSING CIRCUIT OF DISPLAY DEVICE FOR SENSING PIXEL CURRENT

BACKGROUND

1. Technical Field

The present disclosure relates to a sensing circuit of a display device, and more particularly, to a sensing circuit of a display device, which is capable of sensing a pixel current of a display panel.

2. Related Art

Among display devices, an organic light emitting diode (OLED) display device includes a display panel having OLED pixels arranged in a matrix shape, and displays a screen by driving the pixels according to the gray scales of display data.

Each of the pixels includes a switching transistor and driving transistor to drive the corresponding OLED. The driving transistor may have a different electrical characteristic for each pixel. The electrical characteristic of the driving transistor may include a threshold voltage or mobility. When a driving time is accumulated, the electrical characteristic may be changed by a degradation of the driving transistor.

The electrical characteristic of each pixel may be decided by the electrical characteristic of the corresponding driving transistor, and a deviation in electrical characteristic between the pixels may be increased with the accumulation of the driving time.

The electrical characteristic of the pixel may be defined as a pixel characteristic, and the deviation in electrical characteristic between the pixels may be defined as a pixel deviation.

The pixels may be driven to have luminances with a difference corresponding to the pixel deviation for display data having the same gray scale.

The pixel deviation between the pixels may be compensated for through various methods. For example, the pixel deviation may be compensated for through an external compensation method.

The external compensation method is to compensate for a pixel deviation outside the display panel. For this operation, the external compensation method reads out information for displaying a pixel characteristic on the display panel, and reflects the read information to drive the display panel. A pixel current generated by the driving transistor of the pixel may be used as the information for displaying the pixel characteristic.

According to the external compensation method, an external driver reads out a pixel current of a pixel and senses the read pixel current, and an application processor computes a compensation value corresponding to the sensed pixel current, and compensates for a driving signal provided to the pixel using the compensation value.

When the driver reads out the pixel current during the above-described process, the driver may read out a leakage current as well as the pixel current. The current read out by the driver may be referred to as a sensing current, and the sensing current may contain a pixel current and a leakage current. The leakage current is not selected as a sensing target, but may contain a current introduced from pixels sharing an input terminal of the driver.

When a pixel current with a magnitude of several pico-levels to several nano-levels is sensed, the external compensation method has a difficulty in accurately sensing only the pixel current except for a leakage current of which the polarity and magnitude cannot be estimated.

The driver includes a sensing circuit for sensing a pixel current. The sensing circuit includes an analog-to-digital converter (ADC). In this case, the ADC is required to have high resolution for the pixel current. However, the sensing circuit of the driver has a difficulty in satisfying the requirement due to a leakage current.

Therefore, when a pixel current is sensed through the external compensation method, the sensing circuit of the driver needs to be designed to be insensitive to a leakage current in order to accurately sense the pixel current.

The driving transistor of each pixel is generally driven by a high voltage. Therefore, a bias voltage in a wide range from the positive level to the negative level may be formed at the input terminal of the external driver, to which the pixel current is applied.

The bias voltage formed in a wide range at the input terminal of the driver may be divided into a plurality of ranges (for example, positive level and negative level) during a sensing operation. For this operation, the driver must be designed to include sensing circuits corresponding to the divided ranges of the bias voltage, respectively, and a positive-level pixel current and a negative-level pixel current may be sensed through different sensing circuits.

When the plurality of sensing circuits are designed, the sensing circuits occupy a large area in the driver. Thus, the manufacturing cost of the driver is inevitably increased.

Furthermore, in the external compensation method, the flow direction of the sensing current read out by the driver may be changed.

For example, when a specific voltage is applied to the anode of an OLED in order to sense a pixel current, a sensing current may flow from the driver to the display panel. In this case, the sensing circuits (for example, integrators) have a common mode voltage fixed to a high level by the sensing current, and a sensing range for sensing the pixel current of the sensing current is clamped by the common mode voltage. As a result, the sensing range for sensing the pixel current of the sensing current through the sensing circuits of the driver may be limited to a range equal to or more than the common mode voltage.

SUMMARY

Various embodiments are directed to a sensing circuit of a display device, which is capable of accurately sensing only a pixel current except a leakage current, in order to determine a pixel characteristic through an external compensation method.

Also, various embodiments are directed to a sensing circuit of a display device, which is capable of sensing a bias voltage distributed in a wide range in response to a pixel current in order to determine a pixel characteristic.

Also, various embodiments are directed to a sensing circuit of a display device, in which a circuit for sensing a pixel characteristic can be implemented with a small area, and which has economic efficiency.

Also, various embodiments are directed to a sensing circuit of a display device, which is capable of sensing a pixel current while a sensing range is not limited even when a flow direction of the pixel current is changed depending on a voltage applied to a display panel.

In an embodiment, a sensing circuit of a display device may include: a current receiving unit configured to receive an input current containing at least a leakage current between a pixel current and the leakage current, convert the pixel current at a preset current ratio, and output the converted pixel current to a first node; a current source unit configured to provide a predetermined amount of source current to the first node; a current sinking unit configured to sink a predetermined amount of sinking current from the first node; a current detection unit configured to provide a detected current corresponding to the leakage current to the first node; and a detection signal output unit configured to sample an offset voltage corresponding to the leakage current using the detected current, remove the leakage current from the input current using the offset voltage, and output a detection signal corresponding to the pixel current obtained by removing the leakage current from the input current.

In another embodiment, a sensing circuit of a display device may include: a current receiving unit configured to receive an input current containing at least a leakage current between a pixel current and the leakage current, convert the pixel current at a preset current ratio, and output the converted pixel current to a first node; a current source unit configured to provide a predetermined amount of source current; a current sinking unit configured to sink a predetermined amount of sinking current; a current detection unit configured to provide a detected current corresponding to the leakage current; and a detection signal output unit configured to sample an offset voltage corresponding to the leakage current using the detected current during a first period in which the input current containing the leakage current is received, and remove the leakage current from the input current using the offset voltage and output a detection signal corresponding to the pixel current obtained by removing the leakage current from the input current, during a second period in which the input current containing the pixel current and the leakage current is received.

According to the embodiments of the present invention, the sensing circuit of the display device can sense a pixel characteristic based on an electrical characteristic of a driving transistor through an external compensation method, and sense only the pixel current except the leakage current, thereby improving the sensing efficiency.

Furthermore, the sensing circuit can sense a bias voltage level distributed in a wide range in order to determine a pixel characteristic of a pixel, and the circuit for sensing can be implemented with a small area. Thus, a driver for performing the external compensation method can be manufactured at a low cost.

Furthermore, the sensing circuit can provide an environment in which a common mode voltage of the sensor used for sensing can be selected, such that the sensing range is not limited even when the direction of the pixel current is changed.

DETAILED DESCRIPTION

Figure 1:
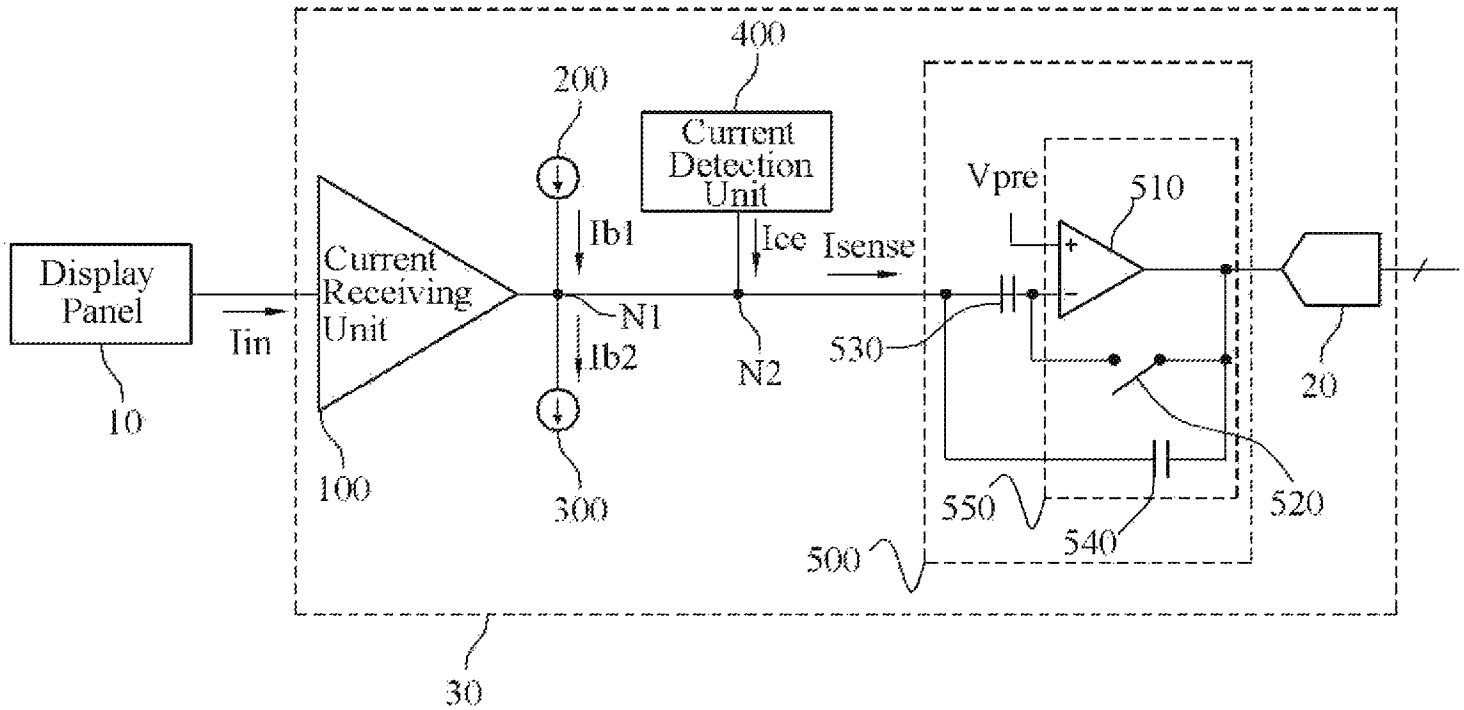
FIG. 1 is a block diagram illustrating a sensing circuit of a display device according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a block diagram illustrating a sensing circuit of a display device according to an embodiment of the present invention.

The sensing circuit according to the present embodiment, which serves to sense a pixel characteristic through an external compensation method, may be configured in a driver 30 outside a display panel 10. The driver 30 may be understood as a driving driver for providing a driving signal to the display panel in response to display data.

Therefore, the driver 30 is configured to provide a driving signal (not illustrated) corresponding to the display data to the display panel 10, and receive a sensing current Iin from the display panel 10.

Referring to FIG. 1, the driver 30 includes the sensing circuit of the display device according to the present embodiment, and the sensing circuit of the display device includes a current receiving unit 100, a current source unit 200, a current sinking unit 300, a current detection unit 400 and a detection signal output unit 500.

A detection signal of the detection signal output unit 500 may be provided as a compensation signal to an application processor (not illustrated) outside the driver 30 through an analog-to-digital converter (ADC) 20, and the application processor may compute a compensation value corresponding to the compensation signal, and reflect the compensation value into a driving signal outputted to the display panel 10 from the driver 30.

The driver 30 has an input terminal to read out the input current Iin inputted through a sensing line. When a pixel characteristic is sensed, the corresponding pixel outputs a pixel current to the input terminal of the driver 30 through the sensing line, the pixel current representing the pixel characteristic or an electrical characteristic of a driving transistor (not illustrated). At this time, the input current Iin of the input terminal of the driver 30 may contain the pixel current and a leakage current Ileak.

The leakage current Ileak occurs regardless of an operation of the driving transistor of the pixel. The driver 30 has input terminals corresponding to a plurality of pixels, and the input terminals of the driver 30 are simultaneously connected to sensing lines of the plurality of pixels in the display panel 10. Therefore, a leakage current of a pixel which is not selected for sensing of a pixel characteristic or a leakage current generated through noise caused by various factors may for the leakage current Ileak at the input terminals of the driver 30. The magnitude and polarity of the leakage current Ileak are difficult to estimate.

The input terminal of the driver 30 may be understood as an input terminal of the current receiving unit 100. That is, the current receiving unit 100 receives the input current Iin.

The input current Iin may contain a pixel current Idata and a leakage current Ileak when the pixel characteristic of a pixel is sensed. On the other hand, the input current Iin may include only the leakage current Ileak when the pixel characteristic of the pixel is not sensed.

The current receiving unit 100 may convert the input current Iin. For this operation, the current receiving unit 100 may include a current amplifier. The current receiving unit 100 may serve as a kind of buffer.

For example, the current receiving unit 100 may amplify the pixel current Idata at a ratio of 1:1. The amplification corresponds to a conversion of the input current Iin. In this case, the current receiving unit 100 outputs a current having the same magnitude as the input current Iin. The current outputted by the current receiving unit 100 may also be referred to as the input current Iin.

The current receiving unit 100 performs a function of separating voltage environments of the input side and the output side.

Since the pixels of the display panel 10 are driven in a first voltage environment, the input side of the current receiving unit 100 may be considered to have the first voltage environment. The first voltage environment at the input side of the current receiving unit 100 may indicate a high voltage environment of 10V or more, for example.

The current source unit 200, the current sinking unit 300, the current detection unit 400 and the detection signal output unit 500, which are driven in a second voltage environment, may be configured at the output side of the current receiving unit 100, and the current source unit 200, the current sinking unit 300, the current detection unit 400 and the detection signal output unit 500 may include transistors which are driven in the second voltage environment. Therefore, the output side of the current receiving unit 100 may be considered to have the second voltage environment. The second voltage environment may indicate a low-voltage environment of several voltages.

As described above, the current receiving unit 100 separates the high voltage environment at the input side from the low voltage environment at the output side.

Since the voltage environment is separated by the current receiving unit 100, the current source unit 200, the current sinking unit 300, the current detection unit 400 and the detection signal output unit 500 may include transistors which have a small channel area while operating in the low voltage environment. Therefore, since the sensing circuit according to the present embodiment can be implemented with a small area, the economic efficiency of the sensing circuit can be improved.

The sensing circuit according to the present embodiment may perform a sensing operation in response to the level of the input current Iin distributed in a wide range by the current receiving unit 100.

A node N1 is formed at the output terminal of the current receiving unit 100, and the current source unit 200, the current sinking unit 300 and the current detection unit 400 are connected to the node N1.

The current source unit 200 provides a predetermined amount of current to the node N1, and the current sinking unit 300 sinks a predetermined amount of current from the node N1. The current provided to the node N1 by the current source unit 200 is referred to as a source current Ib1, and the current sunk from the node N1 by the current sinking unit 300 is referred to as a sinking current Ib2. In the present embodiment, the source current Ib1 may be set to a larger amount than the sinking current Ib2, or the sinking current Ib2 may be set to a larger amount than the source current Ib1. The current amounts may be set to various values by a designer in consideration of the sensing environment of the source current Ib1 or the sinking current Ib2.

The current detection unit 400 provides a detected current Ice corresponding to the input current Iin containing only a leakage current Ileak to the node N1. In other words, the current detection unit 400 provides the detected current Ice corresponding to the leakage current Ileak to the node N1.

From the viewpoint of the node N1, the sinking current Ib2 is equal to the sum of the source current Ib1, the leakage current Ileak and the detected current Ice. At this time, since the source current Ib1 and the sinking current Ib2 have the predetermined current values, the detected current Ice is decided by the leakage current Ileak.

For a specific example, the following descriptions are based on the supposition that the input current Iin contains only the leakage current Ileak.

When the sinking current Ib2 is 1,000 μA, the source current Ib1 is 900 μA and the leakage current Ileak is 90 μA, the detected current Ice is 10 μA. At this time, a capacitor 530 described later samples the detected current Ice while a switch 520 is turned on. In other words, the capacitor 530 samples a voltage corresponding to the leakage current Ileak.

That is, the current detection unit 400 serves to supply the detected current Ice corresponding to the leakage current Ileak to the node N1, and thus has a function of detecting the leakage current Ileak.

The current detection unit 400 may include passive elements such as a diode, resistor and sample/hold circuit, in order to provide the detected current Ice corresponding to the leakage current Ileak.

The detection signal output unit 500 samples and holds the leakage current Ileak, detects a pixel current Idata from which the leakage current Ileak is removed, and outputs the pixel current Idata to the ADC 20.

When the amount of the source current Ib1 is equal to the amount of the sinking current Ib2, the magnitude and direction of the detected current Ice may be changed depending on the magnitude and direction of the leakage current Ileak. However, the detected current Ice provided by the current detection unit 400 needs to flow in a constant direction, depending on the elements constituting the current detection unit 400. Therefore, the amount of the source current Ib1 provided by the current source unit 200 and the amount of the sinking current Ib2 sunk by the current sinking unit 300 may be set to different values, such that the detected current Ice provided to the node N1 flows in the constant direction regardless of the magnitude or direction of the leakage current Ileak.

The detection signal output unit 500 includes the capacitor 530 and an integration circuit 550.

The capacitor 530 is configured in the detection signal output unit 500. The capacitor 530 is configured between the integration circuit 550 and a node N2 connecting the current detection unit 400 to the node 1, and forms an offset voltage by the detected current Ice flowing to the node N1 through the node N2. At this time, the offset voltage corresponds to a voltage obtained by sampling and holding the leakage current Ileak.

The detection signal output unit 500 includes the integration circuit 550, and the integration circuit 550 includes an amplifier 510, a switch 520 and a capacitor 540.

The amplifier 510 has two input terminals including a positive terminal (+) and a negative terminal (−), a common mode voltage Vpre is applied to the positive terminal (+), and a second electrode of the capacitor 530 is connected to the negative terminal (−). The switch 520 is connected between an output terminal and the negative terminal (−) of the amplifier 510, and the capacitor 540 for sampling the data current Idata is connected between the output terminal of the amplifier 510 and a first electrode of the capacitor 530.

In the above-described configuration, the switch 520 is turned on in response to a first period PS for sampling the leakage current Ileak, and turned off in response to a second period PH for holding the leakage current Ileak. The first period PS indicates a period in which the input current Iin contains only the leakage current Ileak because the pixel characteristic is not sensed, and the second period PH indicates a period in which the input current Iin contains the pixel current Idata and the leakage current Ileak because the pixel characteristic is sensed.

Figure 2:
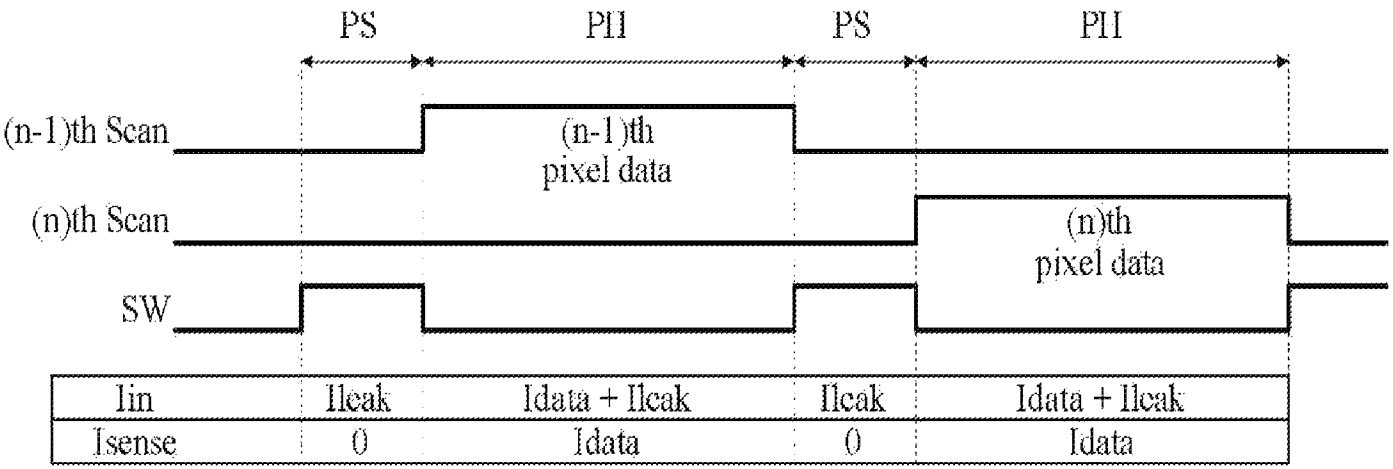
FIG. 2 is a timing diagram for describing an operation of the sensing circuit of FIG. 1.

The operation of the sensing circuit according to the embodiment of FIG. 1 will be described with reference to FIG. 2. In FIG. 2, "SW" represents a control signal to control the switch 520 in response to the first period PS or the second period.

First, the operation of the sensing circuit in the first period PS will be described.

During the first period, the input current Iin contains only the leakage current Ileak. Therefore, the detected current Ice is formed by detecting the leakage current Ileak, and the capacitor 530 samples an offset voltage by the detected current Ice corresponding to the leakage current Ileak. At this time, a current Isense inputted to the negative terminal (−) of the amplifier 510 of the integration circuit 550 is "0".

As described above, an offset voltage corresponding to the leakage current Ileak is sampled by the capacitor 530 during the first period PS.

Next, the operation of the sensing circuit in the second period PH will be described.

During the second period, the input current Iin contains the pixel current Idata and the leakage current Ileak. At this time, the capacitor 530 holds the offset voltage sampled in the first period PS. That is, an offset voltage is formed in the negative terminal (−) of the amplifier 510 by the capacitor 530.

When the current receiving unit 100 outputs the input current Iin to the detection signal output unit 500 during the second period PH, the leakage current Ileak contained in the input current Iin is removed through the offset voltage formed by the capacitor 530. Therefore, the pixel current Idata from which the leakage current Ileak of the input current Iin is removed is inputted to the negative terminal (−) of the amplifier 510 of the integration circuit 550. That is, the current Isense inputted to the negative terminal (−) of the amplifier 510 of the integration circuit 550 in FIG. 2 corresponds to the pixel current Idata.

As described above, the detection signal output unit 500 forms an offset voltage corresponding to the leakage current Ileak during the first period PS in which the input current Iin containing only the leakage current Ileak is inputted. Furthermore, the detection signal output unit 500 removes the leakage current Ileak using the offset voltage formed in the second period PH in which the input current Iin containing the leakage current Ileak and the pixel current Idata is inputted, performs sampling and integration on the pixel current Idata, and outputs a detection signal.

Therefore, the sensing circuit according to the present embodiment may sense the pixel current Idata with a high resolution, the pixel current Idata being obtained by removing the leakage current Ileak from the input current Iin.

The sensing circuit according to the present embodiment may be configured to vary the common mode voltage Vpre of the detection signal output unit 500. The detection signal output unit 500 may include a switching circuit (not illustrated) capable of selecting one of voltages having a plurality of levels, such that the selected voltage is applied as the common mode voltage Vpre to the positive terminal (+) of the amplifier 510. In the above-described configuration, the common mode voltage Vpre may have the selected level.

In other words, the common mode voltage Vpre may be selected to one level among the plurality of preset levels in consideration of the state of the current Isense inputted to the negative terminal (−) of the amplifier 510. The state of the current Isense may include the magnitude or direction of the current Isense inputted to the negative terminal (−) of the amplifier 510.

For example, when a current of an OLED in the display panel 10 is sensed, the input current Iin may flow from the driver 30 to the display panel 10. More specifically, when a specific voltage is applied to the anode of the OLED in order to sense the current of the OLED, the input terminal of the driver 30 may have a higher potential than the display panel 10, and a flow of the input current Iin from the driver 30 to the display panel 10 may be formed.

In this case, an input voltage of the negative terminal (−) of the amplifier 510 included in the integration circuit 550 of the detection signal output unit 500 may be formed at a high level corresponding to the pixel current Idata.

When the common mode voltage Vpre is fixed, the input voltage formed at a high level in the negative terminal (−) of the amplifier 510 may be clamped by the common mode voltage Vpre having the fixed level, even though the sampling by the pixel data Idata is normally performed in the capacitor 540. As a result, the range of the pixel current Idata sensed by the detection signal output unit 500 of the driver 30 may be limited by the fixed common mode voltage Vpre.

In order to solve the problem that the sensing range of the pixel current Idata is limited, the sensing circuit according to the present embodiment may be configured to provide the variable common mode voltage Vpre as described above.

Therefore, when the flow of the input current Iin is changed to a flow from the driver 30 to the display panel 10, the sensing circuit can select the low-level common mode voltage Vpre to perform integration, thereby preventing the limitation of the sensing range of the pixel current Idata.

Figure 3:
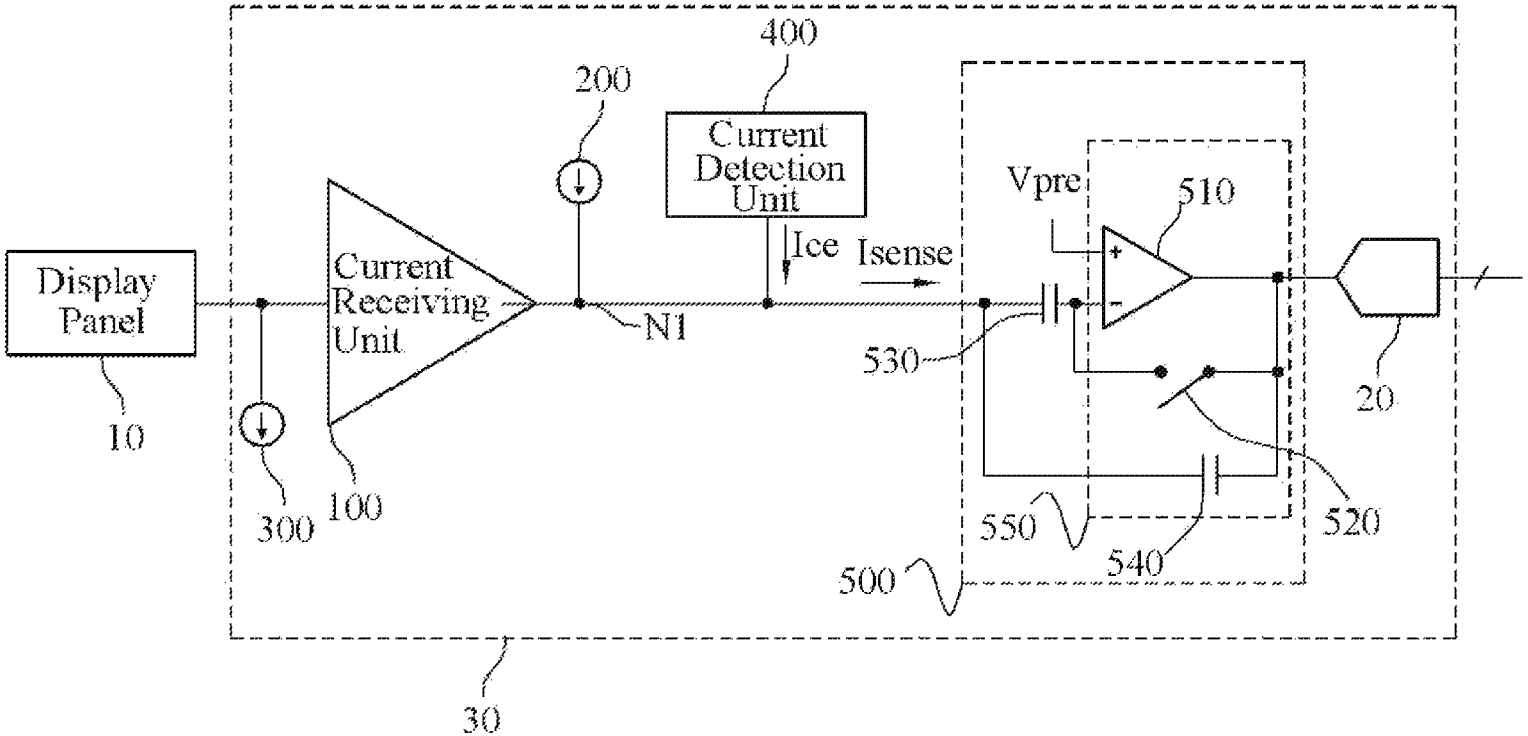
FIG. 3 is a block diagram illustrating a sensing circuit of a display device according to another embodiment of the present invention.
Figure 4:
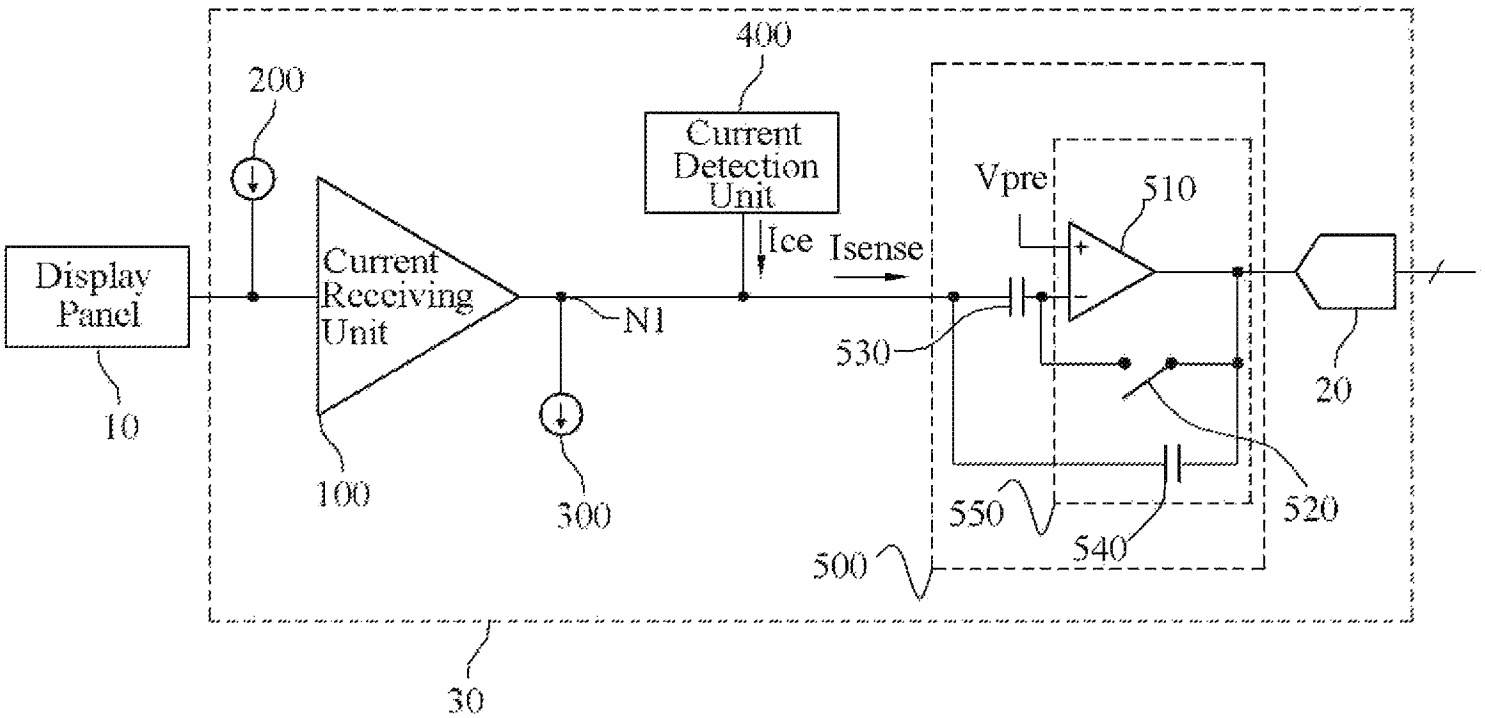
FIG. 4 is a block diagram illustrating a sensing circuit of a display device according to still another embodiment of the present invention.
Figure 5:
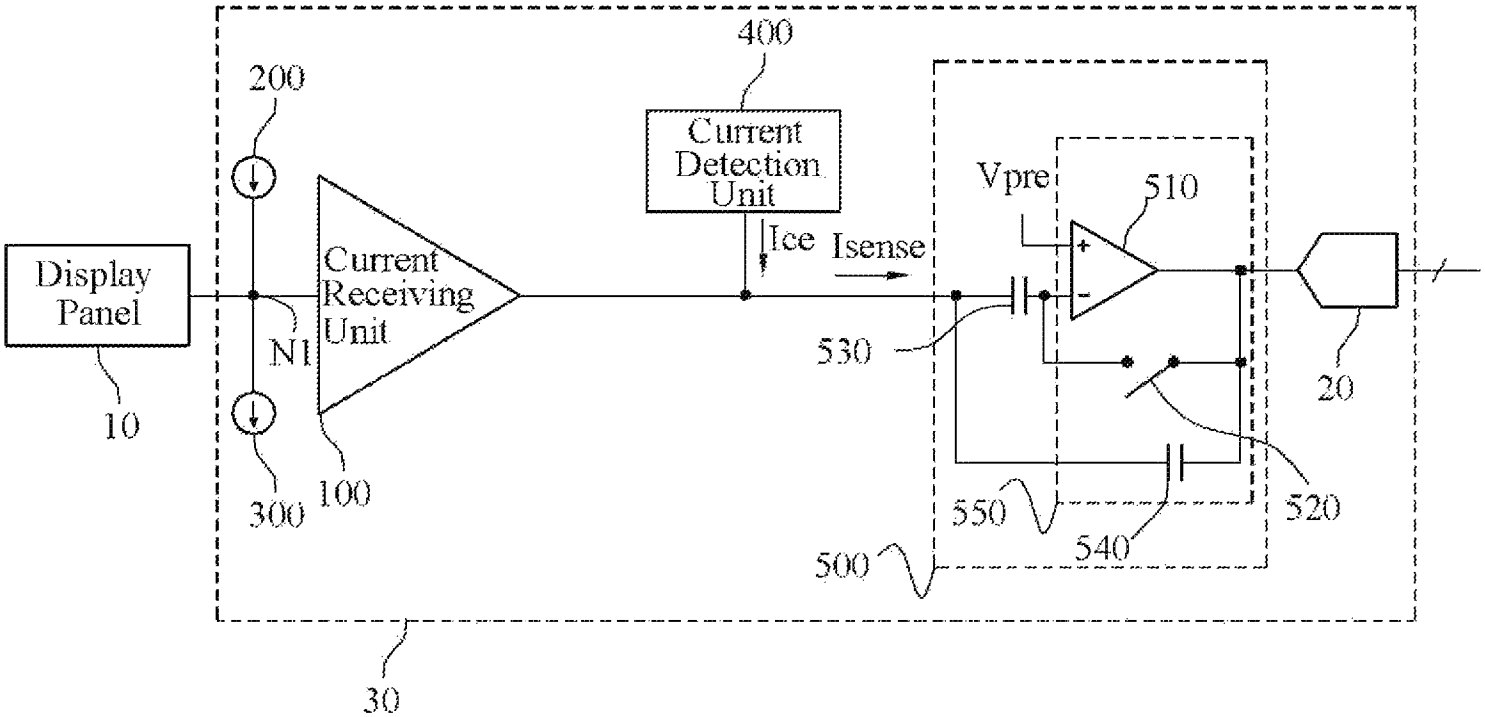
FIG. 5 is a block diagram illustrating a sensing circuit of a display device according to still another embodiment of the present invention.

The present embodiment may be modified as illustrated in FIGS. 3 to 5.

In FIGS. 3 to 5, the duplicated descriptions of the same components as those of FIG. 1 and the functions thereof are omitted herein. Referring to FIGS. 3 to 5, the current source unit 200 and the current sinking unit 300 are arranged in different manners from FIG. 1.

The arrangement of the current source unit 200 and the current sinking unit 300 may be changed depending on an environment or design method of the sensing circuit.

In the embodiment of FIG. 3, the current source unit 200 is connected to the output terminal of the current receiving unit 100 and provides the source current, and the current sinking unit 300 is connected to the input terminal of the current receiving unit 100 and sinks the sinking current.

In the embodiment of FIG. 4, the current source unit 200 is connected to the input terminal of the current receiving unit 100 and provides the source current, and the current sinking unit 300 is connected to the output terminal of the current receiving unit 100 and sinks the sinking current.

In the embodiment of FIG. 5, the current source unit 200 and the current sinking unit 300 are connected to the input terminal of the current receiving unit 100, provide the source current, and sink the sinking current.

Since the configurations and operations of the embodiments of FIGS. 3 to 5 can be understood through the embodiment of FIG. 1 and the descriptions corresponding to the first and second periods PS and PH of FIG. 2, the duplicated descriptions are omitted herein.

In the embodiments of FIGS. 3 and 4, the sensing circuit generates the detected current Ice corresponding to the leakage current Ileak and forms the offset voltage, based on the node N1 connected to the output terminal of the current receiving unit 100, during the first period PS, and performs sampling and integration on the pixel current Idata to output the detection signal during the second period PH, like the embodiment of FIG. 1.

In the embodiment of FIG. 5, however, the sensing circuit generates the detected current Ice and forms the offset voltage, based on the node N1 connected to the input terminal of the current receiving unit 100. Since the operation corresponding to the second period PH in the embodiment of FIG. 5 is performed in the same manner as the embodiment of FIG. 1, the duplicated descriptions thereof are omitted herein.

Through the above-described configuration, the sensing circuit according to the embodiments of the present invention can sense the pixel current to determine a pixel characteristic through the external compensation method, and sense only the pixel current except the leakage current with a high resolution. Thus, the sensing circuit may become insensitive to the leakage current.

Furthermore, the sensing circuit can sense the pixel current distributed in a wide range at the input terminal of the driver, while having a small area. Thus, the economic efficiency of the driver can be improved.

Furthermore, the sensing circuit can select the common mode voltage and provide the sensing environment in which the sensing range of the pixel current is not limited, even when the flow direction of the pixel current is changed depending on a voltage applied to the display panel.

While various embodiments have been described above, it will be understood to those skilled in the art that the embodiments described are by way of example only. Accordingly, the disclosure described herein should not be limited based on the described embodiments.

What is claimed is:

1. A sensing circuit of a display device, comprising:

a current receiving unit configured to receive an input current containing at least a leakage current between a pixel current and the leakage current, convert the pixel current at a preset current ratio, and output the converted pixel current to a first node;

a current source unit configured to provide a predetermined amount of source current to the first node;

a current sinking unit configured to sink a predetermined amount of sinking current from the first node;

a current detection unit configured to provide a detected current corresponding to the leakage current to the first node; and a detection signal output unit configured to sample an offset voltage corresponding to the leakage current using the detected current, remove the leakage current from the input current using the offset voltage, and output a detection signal corresponding to the pixel current obtained by removing the leakage current from the input current, wherein the current detection unit provides the detected current so that the sinking current is equal to the sum of the source current, the leakage current and the detected current.

2. The sensing circuit of claim 1, wherein the current receiving unit performs the conversion through amplification.

3. The sensing circuit of claim 1, wherein the current receiving unit is implemented with a buffer including an amplifier.

4. The sensing circuit of claim 1, wherein the current receiving unit comprises an input terminal having a first voltage environment and an output terminal having a second voltage environment different from the first voltage environment, the second voltage environment has a lower voltage environment than the first voltage environment, and the current source unit, the current sinking unit and the current detection unit share the second voltage environment.

5. The sensing circuit of claim 1, wherein a difference in current amount between the sinking current and the source current is equal to the sum of the leakage current and the detected current.

6. The sensing circuit of claim 1, wherein the current detection unit comprises a passive element for providing the detected current of which the amount corresponds to the leakage current.

7. The sensing circuit of claim 1, wherein the detection signal output unit comprises:

a first capacitor configured to sample and hold the offset voltage corresponding to the leakage current using the detected current; and an integration circuit configured to remove the leakage current from the input current using the offset voltage, and output the detection signal corresponding to the pixel current obtained by removing the leakage current from the input current.

8. The sensing circuit of claim 7, wherein the integration circuit comprises an amplifier configured to generate the detection signal by comparing a voltage corresponding to the pixel current to a common mode voltage, and the common mode voltage is provided as a voltage selected among voltages having a plurality of levels.

9. The sensing circuit of claim 1, wherein the detection signal output unit samples and holds the offset voltage corresponding to the leakage current using the detected current during a first period in which the input current containing the leakage current is received, and removes the leakage current from the input current using the offset voltage and outputs the detection signal corresponding to the pixel current obtained by removing the leakage current from the input current, during a second period in which the input current containing the pixel current and the leakage current is received.

* * * * *